US010551787B2

(12) United States Patent
Sawa et al.

(10) Patent No.: US 10,551,787 B2
(45) Date of Patent: Feb. 4, 2020

(54) WASTE TONER COLLECTING DEVICE AND IMAGE FORMING APPARATUS

(71) Applicant: SHARP KABUSHIKI KAISHA, Sakai, Osaka (JP)

(72) Inventors: Yuji Sawa, Sakai (JP); Shinichi Takeda, Sakai (JP); Noriaki Taguchi, Sakai (JP); Hiroki Kanemitsu, Sakai (JP); Hideaki Kadowaki, Sakai (JP)

(73) Assignee: SHARP KABUSHIKI KAISHA, Sakai, Osaka (JP)

( * ) Notice: Subject to any disclaimer, the term of this patent is extended or adjusted under 35 U.S.C. 154(b) by 0 days.

(21) Appl. No.: 16/203,368

(22) Filed: Nov. 28, 2018

(65) Prior Publication Data

US 2019/0171156 A1 Jun. 6, 2019

(30) Foreign Application Priority Data

Dec. 1, 2017 (JP) ..... 2017-231434

(51) Int. Cl.
*G03G 21/12* (2006.01)
*G03G 21/10* (2006.01)

(52) U.S. Cl.
CPC ..... *G03G 21/12* (2013.01); *G03G 21/105* (2013.01)

(58) Field of Classification Search
CPC ..... G03G 21/10; G03G 21/105; G03G 21/12
See application file for complete search history.

(56) References Cited

U.S. PATENT DOCUMENTS

2007/0081833 A1* 4/2007 Koyama ..... G03G 15/0872 399/258
2011/0280613 A1* 11/2011 Kadowaki ..... G03G 21/12 399/106
2017/0329279 A1* 11/2017 Hirayama ..... G03G 21/10

FOREIGN PATENT DOCUMENTS

JP H09-160456 A 6/1997

OTHER PUBLICATIONS

Machine Translation of JP H09-160456. Jun. 20, 1997. (Year: 1997).*

* cited by examiner

*Primary Examiner* — Carla J Therrien
(74) *Attorney, Agent, or Firm* — ScienBiziP, P.C.

(57) ABSTRACT

A waste toner collecting device includes a waste toner container having an opening at an upper portion, and a shutter mechanism that opens or closes the opening. The shutter mechanism includes a receiving portion including an insertion port through which the waste toner discharging unit is inserted, the receiving portion having an inner space connected with an inner space of the waste toner container through the opening, a shutter member disposed in the receiving portion to be movable between an open position and a closing position, and an urging member that urges the shutter member to the closing position. The shutter member includes a ridge on an upper portion of an outer circumferential surface. The ridge has a protrusion height corresponding to a gap between the outer circumferential surface and an inner circumferential surface of the receiving portion.

9 Claims, 5 Drawing Sheets

WASTE TONER COLLECTING DEVICE AND IMAGE FORMING APPARATUS

BACKGROUND

1. Field

The present disclosure relates to a waste toner collecting device and an image forming apparatus, and particularly to, for example, a waste toner collecting device that collects waste toner discharged from a waste toner discharging unit of an apparatus body, and to an image forming apparatus including the waste toner collecting device.

2. Description of the Related Art

Japanese Unexamined Patent Application Publication No. 9-160456 discloses an example of an existing waste toner collecting device. The waste toner case disclosed in Japanese Unexamined Patent Application Publication No. 9-160456 includes a nozzle guide disposed in a photoconductor unit and into which a nozzle for discharging waste toner is inserted. The nozzle guide includes a discharge port, through which waste toner is discharged from the nozzle to a containing container, a shutter unit that opens or closes the discharge port, and a spring that urges the shutter into a closing position for opening or closing the shutter in conjunction with an operation of inserting the nozzle.

The waste toner case disclosed in Japanese Unexamined Patent Application Publication No. 9-160456 is removable from an apparatus body of the image forming apparatus to be replaceable with a new waste toner case when having a waste toner containing container filled with waste toner. The waste toner case disclosed in Japanese Unexamined Patent Application Publication. No. 9-160456 also includes a shutter mechanism that opens or closes in conjunction with an operation of inserting the nozzle to prevent the collected waste toner from leaking to the outside regardless of when the filled waste toner case is erroneously brought down during replacement.

However, as in the technology disclosed in Japanese Unexamined Patent Application Publication No. 9-160456, moving the nozzle guide while the shutter is moved in conjunction with an operation of inserting the nozzle requires a wide clearance between the shutter and the nozzle guide. If the waste toner case that has collected the waste toner is erroneously brought down, the clearance is generated between the discharge port and the shutter in the closing position at which it closes the discharge port, and the reclaimed waste toner is allowed to leak out through the clearance to make the surroundings dirty.

It is desirable to provide a new waste toner collecting device and a new image forming apparatus.

It is also desirable to provide a waste toner collecting device and an image forming apparatus that can appropriately prevent waste toner from leaking while the container is removed from an apparatus body.

SUMMARY

According to an aspect of the disclosure, there is provided a waste toner collecting device that waste toner discharged from a waste toner discharging unit of an apparatus body, the waste toner collecting device including a waste toner container including, at an upper portion, an opening that receives the waste toner; and a shutter mechanism that is disposed above the opening and that opens or closes the opening. The shutter mechanism includes a cylindrical receiving portion including, at one end, an insertion port through which the waste toner discharging unit is inserted the receiving portion having an inner space connected with an inner space of the waste toner container through the opening, a shutter member having a cylinder shape extending along an inner circumferential surface of the receiving portion, the shutter member being disposed in the receiving portion to be movable between an open position, in which the shutter member opens the opening, and a closing position, in which the shutter member closes the opening, and an urging member that urges the shutter member to the closing position. The shutter member includes a ridge on an upper portion of an outer circumferential surface, the ridge having a protrusion height corresponding to a gap between the outer circumferential surface and an inner circumferential surface of the receiving portion.

DESCRIPTION OF THE EMBODIMENTS

First Embodiment

Description on Image Forming Apparatus Including Waste Toner Collecting Device

Figure 1:
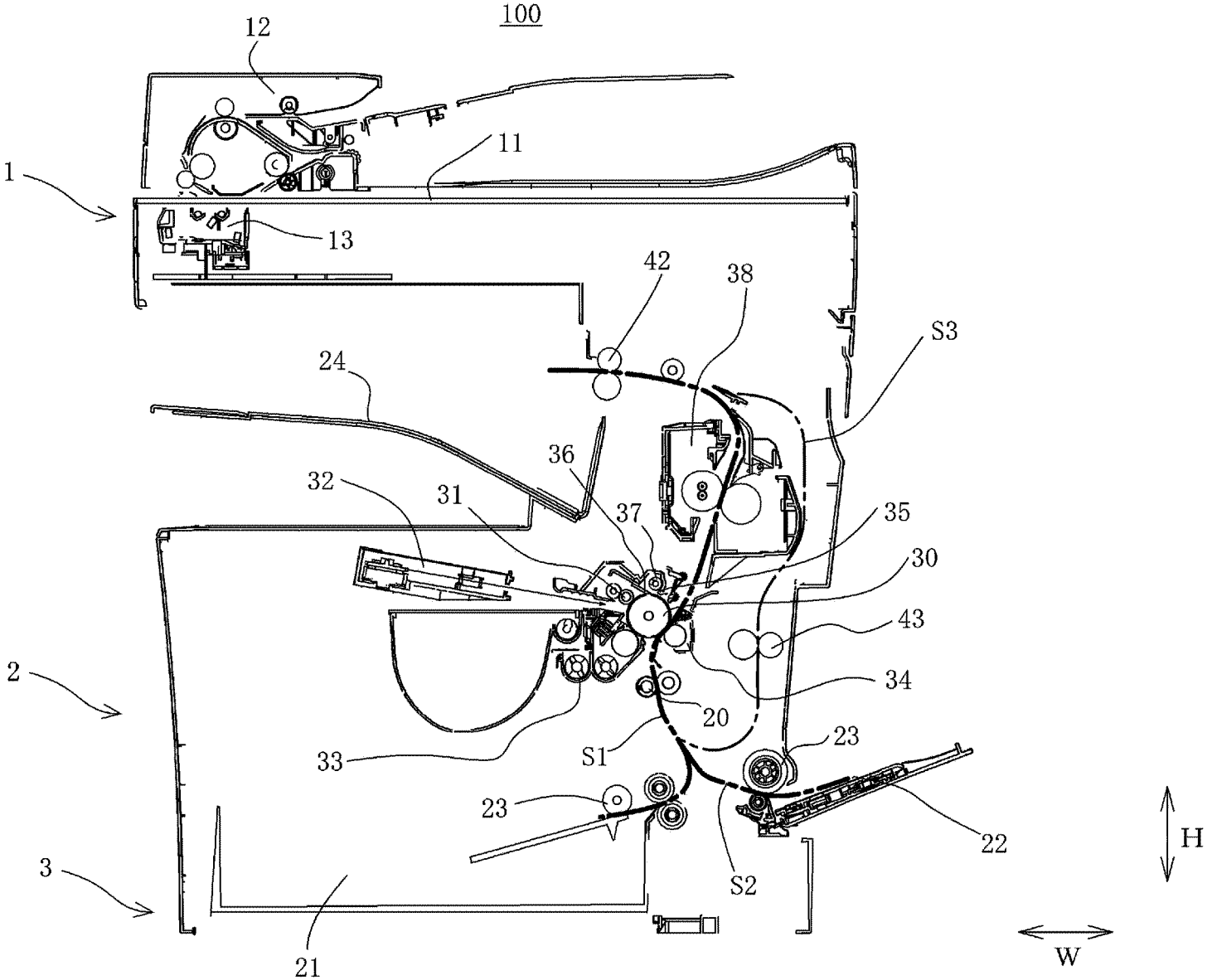
FIG. 1 is a schematic diagram of the structure of an image forming apparatus according to a first embodiment of the disclosure.

An image forming apparatus 100 according to the present embodiment is an electrophotographic image forming apparatus. As illustrated in FIG. 1, the image forming apparatus 100 includes an image reading unit 1, an image forming unit 2 disposed below the image reading unit 1, and a sheet feeding unit 3 disposed below the image forming unit 2.

The image reading unit 1 includes a document receiving table 11, formed from a transparent glass, an automatic document feeder (ADF) 12, which automatically feeds a document onto the document receiving table 11, and an original image reading unit 13, which scans the image of the document placed on the document receiving table 11 and which reads the image.

The image forming unit 2 includes a photoconductor drum 30 and various units for performing electrophotographic processing disposed around the photoconductor drum 30.

Around the photoconductor drum 30, a charging unit 31, an optical scanning unit 32, a development unit 33, a transfer unit 34, a cleaning device 35, and a static eliminating unit (not illustrated) are arranged in this order.

The charging unit 31 uniformly charges the surface of the photoconductor drum 30 at a predetermined potential. The optical scanning unit 32 scans a light image on the uniformly charged photoconductor drum 30 to write an electrostatic latent image. The development unit 33 attaches charged toner particles to the electrostatic latent image written by the optical scanning unit 32 to form the latent image into a visible image. The transfer unit 34 transfers the visible toner image formed on the photoconductor drum 30 to a transfer sheet. The cleaning device 35 removes a developer remaining on the photoconductor drum 30 with a cleaning blade 36 to be ready for recording a new image on the photoconductor drum 30. The toner remaining after transfer and removed from the photoconductor drum 30 with the cleaning blade 36 is transported by a waste toner transport screw 37 in the vertical direction (upward) in the drawing, and into a waste toner collecting device 60 (refer to FIG. 2) disposed between a front cabinet of the image forming apparatus 100 and the image forming unit 2. The static eliminating unit eliminates static electricity from the surface of the photoconductor drum 30 cleaned by the cleaning device 35 to make the electricity on the photoconductor charged by the charging unit 31 uniform.

The image forming unit 2 also includes a fixing unit 38, which melts the toner image transferred to the transfer sheet by the transfer unit 34 and fixes the toner image onto the sheet with pressure.

The sheet feeding unit 3 includes a multiple sheet feeding portions, that is, at least one sheet feeding cassette 21 and a manual sheet feeding tray 22. The image forming apparatus 100 selects one sheet feeding portion from among the sheet feeding cassette 21 and the manual sheet feeding tray 22. The image forming apparatus 100 also separates transfer sheets one from another using a pickup roller 23 disposed at the selected sheet feeding portion, and transports the transfer sheet to have a leading end of the transfer sheet bitten by a nip portion of registration rollers 20. Here, the registration rollers 20 are stationary. The registration rollers 20 start rotating so that an electrostatic latent image arrives at the transfer unit 34 at exact timing at which the position at which the electrostatic latent image starts to be written on the photoconductor drum 30 coincides with the position at which an image starts to be written on the transfer sheet.

The image forming apparatus 100 includes sheet transport paths S1 and S2, along which a transfer sheet is transported from each sheet feeding portion to the image forming unit 2 and a sheet to which a toner image is fixed is transported to a discharged sheet tray 24, and a back-side-printing sheet transport path S3, along which a transfer sheet is reversely transported for double-side printing. On each transport path, discharging rollers 42 and sheet transport rollers 43 are appropriately disposed to discharge sheets to the discharged sheet tray 24.

Figure 2B:
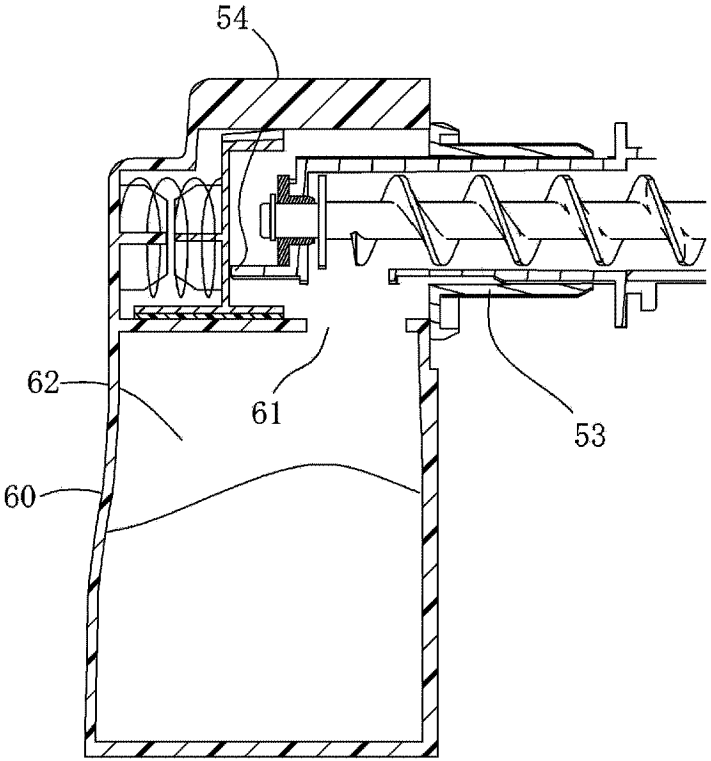
FIGS. 2A and 2B are cross-sectional views of a waste toner collecting device to be coupled with a waste toner discharging unit of a cleaning device.
Figure 2A:
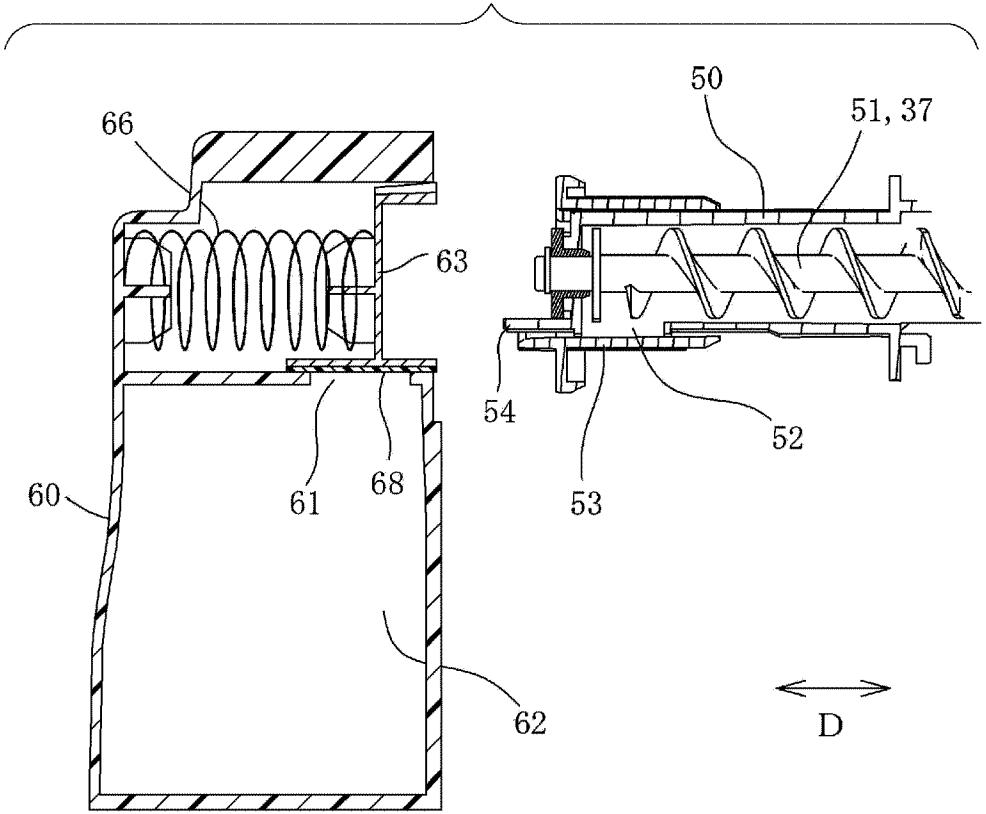

Basic Description of Structure in Which Waste Toner Collecting Device and Waste Toner Discharging Unit are Engaged Subsequently, the basic structure of an embodiment of the present disclosure is described with reference to FIGS. 2A and 2B. FIGS. 2A and 2B are cross-sectional views of the waste toner collecting device 60 coupled with a waste toner discharging unit 50 of the cleaning device 35. FIG. 2A illustrates the waste toner collecting device 60 before being attached to the apparatus body of the image forming apparatus 100, and FIG. 2B illustrates the waste toner collecting device 60 after being attached to the apparatus body of the image forming apparatus 100. The waste toner collecting device 60 is disposed in a space between the front cabinet (not illustrated) of the image forming apparatus 100 and the image forming unit 2. The waste toner collecting device 60 is attached to the apparatus body in the following manner. The front cabinet is opened, the waste toner collecting device 60 is inserted from the opening into the image forming apparatus 100 in the depth direction, and the waste toner collecting device 60 is engaged with the waste toner discharging unit 50 including a waste toner transport screw 51, extending from the cleaning device 35.

The waste toner discharging unit 50 extends toward the front cabinet of the image forming apparatus 100, and includes at an end portion, a waste toner discharge port 52, and a waste toner discharge port shutter 53, which moves to open or close the waste toner discharge port 52. The waste toner discharge port shutter 53 is urged by an urging member, not illustrated, in such a direction as to close the waste toner discharge port 52.

A shutter member 63 of the waste toner collecting device 60 comes into contact with a leading end 54 of the waste toner discharging unit 50 in the course of the waste toner collecting device 60 being installed on the image forming apparatus 100. The shutter member 63 is urged by an urging member 66 to close an opening 61, communicating with a waste toner container 62. The shutter member 63 is pushed when coming into contact with the leading end 54 of the waste toner discharging unit 50 to open the opening 61. At this time, the waste toner discharge port shutter 53 also comes into contact with the wall surface of the waste toner collecting device 60, and moves to open the waste toner discharge port 52. Thus, the waste toner container 62 communicates with the inside of the waste toner discharging unit 50, and can receive the waste toner transported thereto by the waste toner transport screw 51.

Figure 3B:
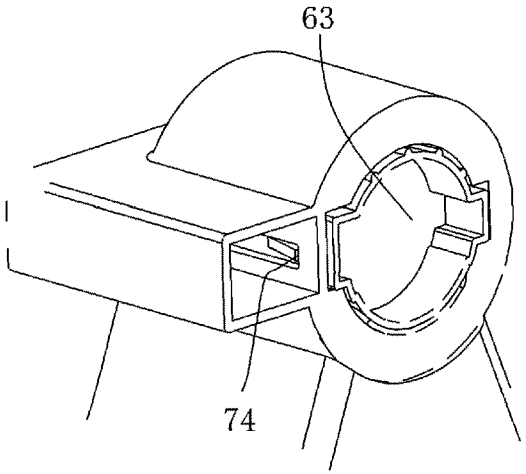
FIGS. 3A, 3B, and 3C are perspective views of the structure and an assembly of a shutter member included in a waste toner collecting device.
Figure 3C:
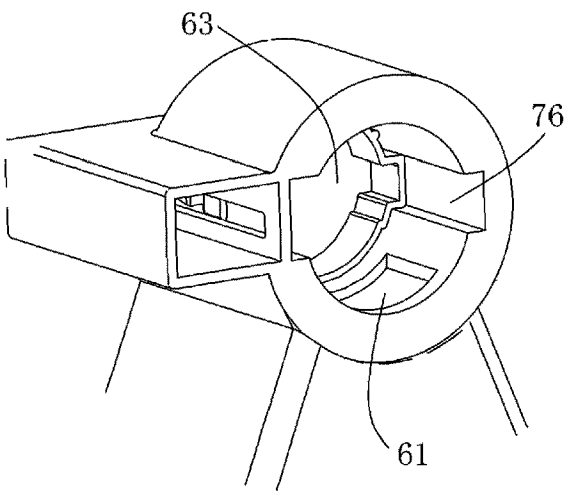
Figure 3A:
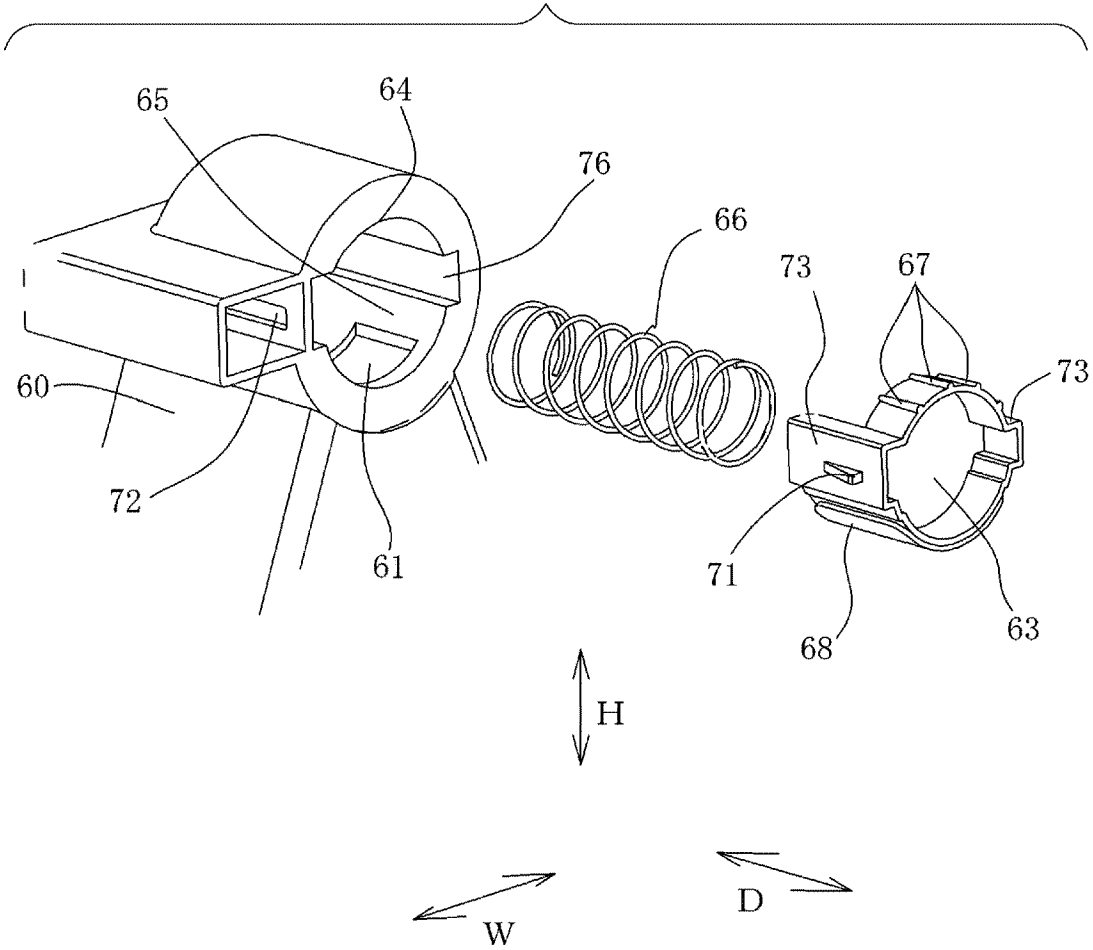

With reference to FIGS. 3A, 3B, and 3B now, the structure of a shutter mechanism according to the present embodiment is described in detail. FIGS. 3A, 3B, and 3B are perspective views of a structure and an assembly of the shutter member 63 included in the waste toner collecting device 60. FIG. 3A illustrates an attachment structure of the shutter member 63, an urging member 66, and the waste toner collecting device 60. As is clear from the drawing, the shutter member 63 has a substantially hollow cylinder shape on a vertically lower (lower side in H direction) semi-cylindrical surface, which serves as a shutter unit that closes the opening 61. The cylindrical surface opposite to the shutter unit has multiple rib-shaped ridges 67, radially protruding from the cylindrical surface.

The shutter member 63 is housed in the waste toner collecting device 60 with the urging member 66 interposed therebetween along a receiving portion 65 from an insertion port 64 of the waste toner collecting device 60, which receives the waste toner discharging unit 50. The receiving portion 65 includes whirlstop guide grooves 76, which guide whirlstops 73. The whirlstops 73 prevent the shutter member 63 from rotating in the circumferential direction and a shutter closing portion from being displaced. A stopper-guide fastening groove 72, which guides a stopper 71, is disposed at a portion of the receiving portion 65 to prevent the shutter member 63 from being ejected from the waste toner collecting device 60 with the urging force of the urging member 66. FIG. 3B illustrates the state of the shutter member 63 closing the opening 61 with the urging force of the urging member 66. As is clear from the drawing, the stopper 71 is fixed at a stopper fixing position 74 of the stopper-guide fastening groove 72.

FIG. 3C illustrates the state of the shutter member 63 pushed inward from the above state in the depth direction (D direction) against the urging force of the urging member 66.

With the operations of the urging member 66, the stopper 71, and the whirlstop guide grooves 76, the shutter member 63 can move in the receiving portion 65 to open or close the opening 61.

Figure 4B:
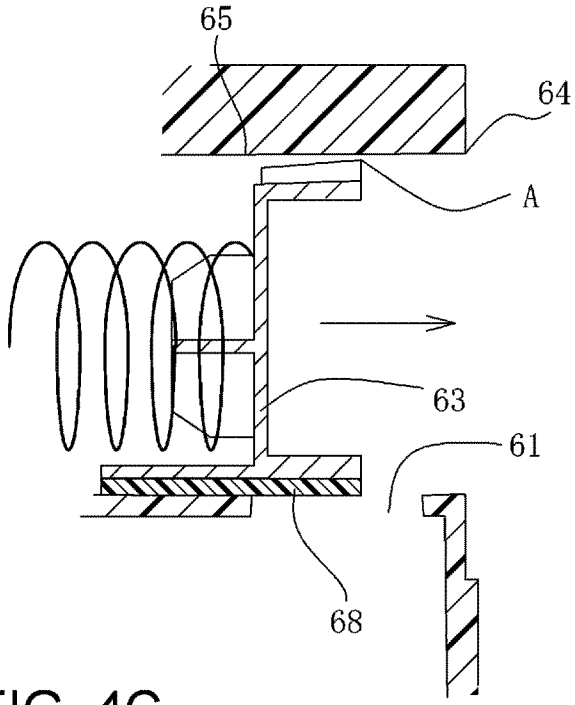
FIGS. 4A, 4B, and 4C are schematic cross-sectional views of the detailed structure and characteristic portions of a shutter mechanism.
Figure 4C:
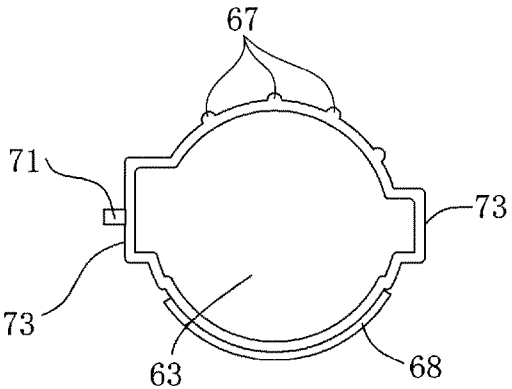
Figure 4A:
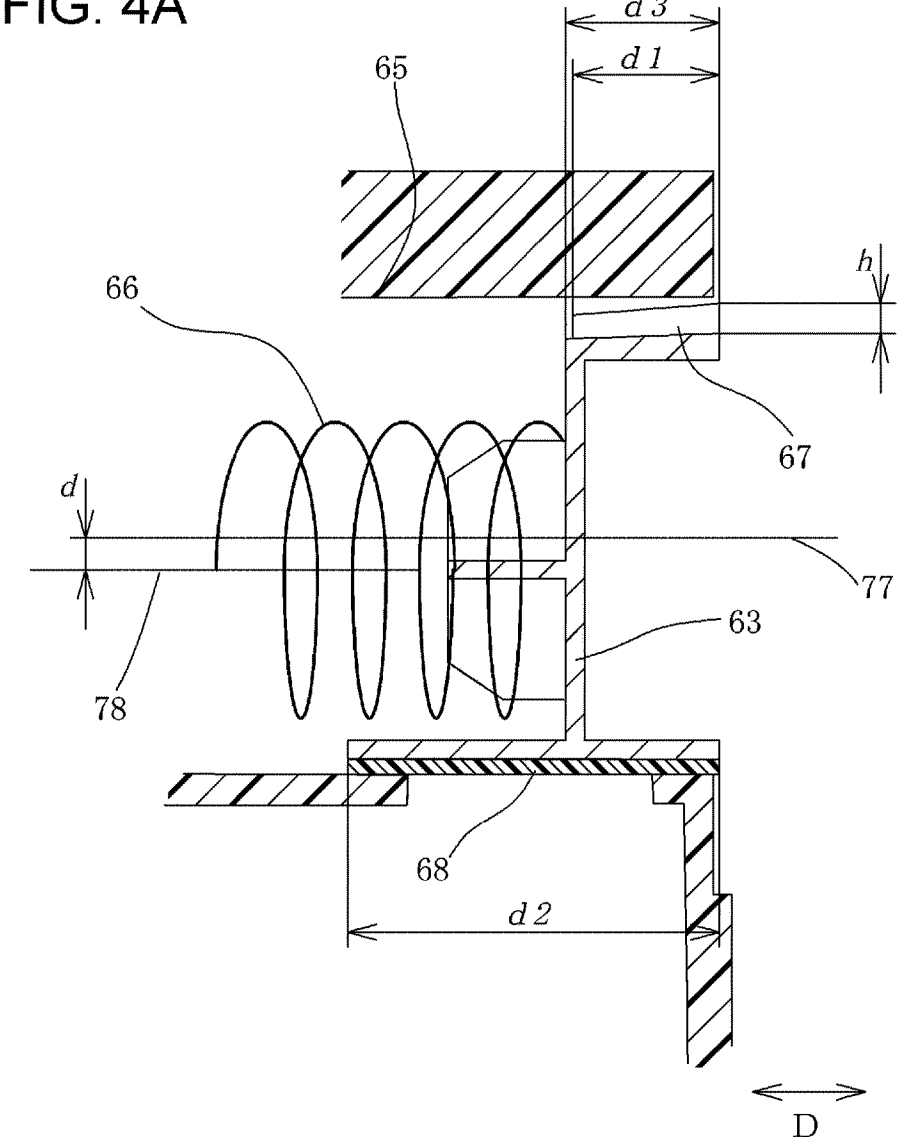

Characteristic portions of the shutter member 63 are described now with reference to FIGS. 4A, 4B and 4C.

FIGS. 4A, 4B and 4C are schematic cross-sectional views of the detailed structure and characteristic portions of the shutter mechanism. FIG. 4A is a schematic cross-sectional view of the shutter member 63 closing the opening 61. FIG. 4B is a schematic cross-sectional view of the shutter member 63 moving to close the opening 61. FIG. 4C is a schematic view of the shutter member 63 viewed from the insertion port 64 side.

To smoothly move the shutter member 63, a large clearance (gap) is needed between the shutter member 63 and the inner wall surface of the receiving portion 65, whereas a large gap leaves a gap after the opening 61 is closed. This gap thus allows collected waste toner to be dispersed to the outside to make the operation site dirty when the waste toner collecting device 60 is erroneously brought down, as described in BACKGROUND.

The present disclosure includes ridges 67 to allow the shutter member 63 to move smoothly while leaving a narrow clearance between itself and the receiving portion and to reliably close the opening 61. The ridges 67 are disposed on an upper portion of the outer circumferential surface of the shutter member 63, that is, on the cylindrical surface opposite to the opening 61. The ridges 67 protrude to have a height corresponding to the gap between the shutter member 63 and the inner circumferential surface of the receiving portion 65. When the cylindrical portion has such an outer diameter that the entire cylindrical surface of the shutter member 63 leaves only a narrow clearance, the clearance between the opening 61 and the shutter member 63 is narrow to make waste toner less likely to leak out. In such a structure, however, the shutter member 63 may rub against the inner circumferential surface of the receiving portion 65 over a wider area while moving in the receiving portion 65 and may fail to reliably open or close the opening 61. On the other hand, in the structure of the present disclosure, the clearance between the shutter member 63 and the inner surface of the receiving portion 65 is narrow only partially, and a frictional force occurs only over a narrow area. Specifically, narrowing the clearance does not increase the frictional resistance. Thus, smooth movement of the shutter member 63 is compatible with narrowing the gap between the opening 61 and the shutter member 63.

The ridges 67 may have a shape of a rib or a protrusion having a smooth leading end. The ridges 67 may be provided in a plurality.

The ridges 67 according to the present embodiment have a length d1 in the depth direction (D direction) that is shorter than a length d2 of the shutter unit that closes the opening 61. The ridges 67 can thus efficiently reduce the frictional resistance caused when the shutter member 63 moves.

The ridges 67 according to the present embodiment are protruding strips extending in the axial direction of the shutter member 63, and have their height h increasing toward the entrance side of the insertion port 64. The shutter member 63 with this structure can thus move without having a leading end portion A rising excessively while the shutter member 63 is moving toward the insertion port 64, as illustrated in FIG. 4B. The portion A is prevented from rising even when the shutter member 63 is moved to the closing position of the opening 61, so that a gap is prevented from being formed between the shutter member 63 and the opening 61.

The shutter member 63 according to the present embodiment includes a first sealing member 68 interposed between the peripheral portion of the opening 61 and the shutter member 63 located at the opening 61. This structure can improve the airtightness of the shutter member 63 located at the opening 61, and can thus effectively prevent the collected waste toner from leaking through the gap between the shutter member 63 and the opening 61.

In the present embodiment, the first sealing member 68 is formed from a polyurethane foam having a thickness of 1 mm, but may be formed from any elastic material such as felt, nonwoven fabric, or foam rubber. Alternatively, the first sealing member may be formed from a cellular material coated with a thin surface layer (having cavities not exposed to the outside).

The urging member 66 according to the present embodiment has a center axis 78 offset (by a distance d) downward from a center axis 77 of the shutter member 63. In this structure, the urging force of the urging member 66 is exerted on the portion A of the shutter member 63 to move the portion A toward the inner circumferential surface of the insertion port 64, so that the shutter member 63 can smoothly moves without moving vertically.

The shutter member 63 according to the present embodiment has a side-wall lower portion (d2) longer in the axial direction than a side-wall upper portion (d3) including the ridges. This structure can reliably close the opening 61, and concurrently, effectively reduce the friction during the movement of the shutter member 63. The length of the side-wall upper portion (d3) may be equal to the length (d1) of the ridges 67 in the axial direction.

According to the present embodiment, the urging member 66 is disposed to urge the shutter member 63 in such a direction as to close the opening 61. Examples usable as the urging member include, besides a compression coil spring, other springs such as a leaf spring or other elastic materials.

Instead of formed from a ABS resin, the waste toner collecting device 60 and the shutter member 63 according to the present embodiment may be formed from other engineering resin.

Second Embodiment

A waste toner collecting device 60 according to a second embodiment is the same as that of the first embodiment except that a second sealing member is disposed at an insertion port 64. The redundant description of the same components is thus omitted.

Figure 5B:
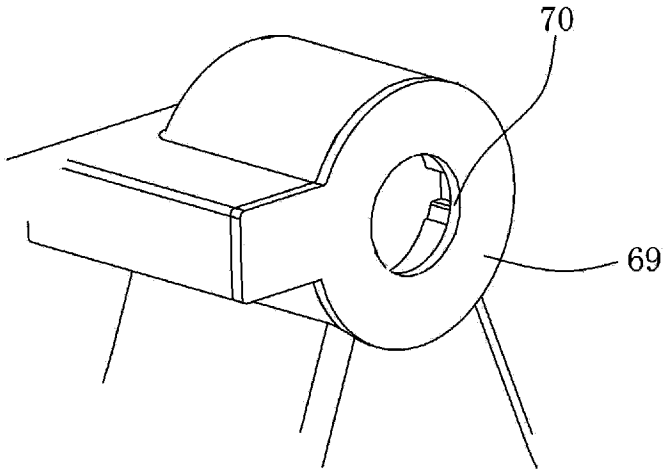
FIGS. 5A and 5B are a schematic cross-sectional view and a perspective view of a portion to which a sealing member is attached.
Figure 5A:
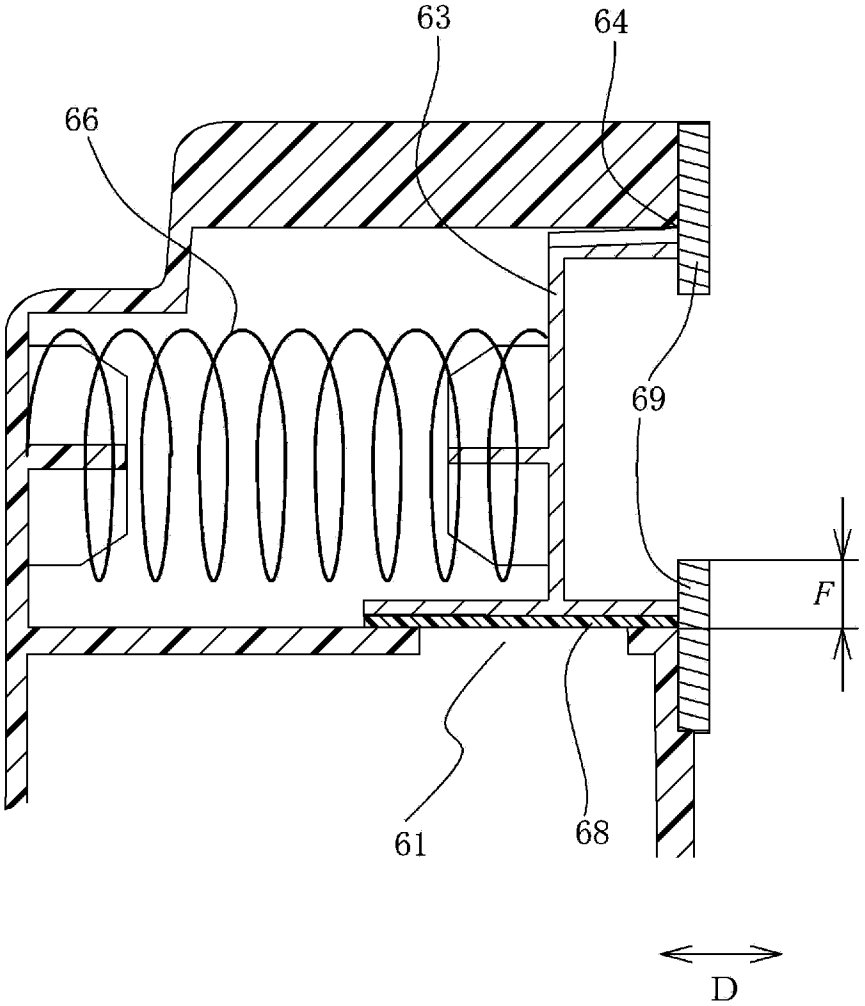

FIGS. 5A and 5B are a schematic cross-sectional view and a perspective view illustrating the portion at which the sealing members are attached. FIG. 5A is a schematic cross-sectional view of the positional relationship between the first sealing member 68 and a second sealing member 69 disposed at the insertion port 64. FIG. 5B is a perspective view of the second sealing member 69 attached. As is clear from the drawings, the second sealing member 69 includes an insertion hole 70, through which the waste toner discharging unit 50 is inserted and having an inner diameter smaller than the inner diameter of the receiving portion 65. When the shutter member 63 is closing the opening 61, the shutter member 63 is in contact with the second sealing member 69. In this structure having a distance F from the opening 61 to the edge of the insertion hole and where the shutter member 63 and the second sealing member 69 are in contact (tightly in contact) with each other, the collected waste toner is prevented from leaking out of the opening 61 regardless of when the waste toner leaks out through the gap between the opening 61 and the shutter member 63.

The embodiments disclosed herein are mere examples in all respects, and are not construed as being limitative.

The present disclosure contains subject matter related to that disclosed in Japanese Priority Patent Application JP 2017-231434 filed in the Japan Patent Office on Dec. 1, 2017, the entire contents of which are hereby incorporated by reference.

It should be understood by those skilled in the art that various modifications, combinations, sub-combinations and alterations may occur depending on design requirements and other factors insofar as they are within the scope of the appended claims or the equivalents thereof.

What is claimed is:

1. A waste toner collecting device that collects waste toner discharged from a waste toner discharging unit of an apparatus body, comprising:

a waste toner container including, at an upper portion thereof, an opening that receives the waste toner; and a shutter mechanism that is disposed above the opening and that opens or closes the opening, wherein the shutter mechanism includes a cylindrical receiving portion including, at one end, an insertion port through which the waste toner discharging unit is inserted, the receiving portion having an inner space connected with an inner space of the waste toner container through the opening, a shutter member having a cylinder shape extending along an inner circumferential surface of the receiving portion, the shutter member being disposed in the receiving portion to be movable between an open position, in which the shutter member opens the opening, and a closing position, in which the shutter member closes the opening, and an urging member that urges the shutter member to the closing position, and wherein the shutter member includes a ridge on an upper portion of an outer circumferential surface of the shutter member, the ridge having a protrusion height corresponding to a gap between the outer circumferential surface of the receiving portion, wherein the urging member is offset downward from a center axis of the shutter member.

2. The waste toner collecting device according to claim 1, wherein the ridge has a length in an axial direction of the shutter member shorter than a length of a side-wall lower portion of the shutter member.

3. The waste toner collecting device according to claim 1, wherein the ridge is a protruding strip extending in an axial direction of the shutter member, the ridge having a protrusion height increasing toward the insertion port.

4. The waste toner collecting device according to claim 1, further comprising a first sealing member disposed at a lower portion of the outer circumferential surface of the shutter member, the first sealing member being interposed between a peripheral portion of the opening and the shutter member located in the closing position.

5. The waste toner collecting device according to claim 1, further comprising a second sealing member having an annular plate shape with an insertion hole, the second sealing member being disposed at an end surface of the insertion port of the receiving portion.

6. The waste toner collecting device according to claim 5, wherein the insertion hole of the second sealing member has a diameter smaller than an inner diameter of the receiving portion, and wherein, when the shutter member is in the closing position, one end surface of the shutter member comes into contact with the second sealing member.

7. The waste toner collecting device according to claim 1, wherein the urging member is a compression coil spring.

8. The waste toner collecting device according to claim 1, wherein the shutter member has a side-wall lower portion in an axial direction longer than a side-wall upper portion.

9. An image forming apparatus, comprising the waste toner collecting device according to claim 1, which is attachable to and removable from an apparatus body.

* * * * *